United States Patent [19]

Leveugle

[11] 4,055,934

[45] Nov. 1, 1977

[54] BAND APPLYING DEVICE FOR A SKEIN WINDING MACHINE

[75] Inventor: Roland Leveugle, Peruwelz, Belgium

[73] Assignee: Croon & Lucke Maschinenfabrik GmbH & Co. KG, Mengen, Germany

[21] Appl. No.: 705,261

[22] Filed: July 14, 1976

[30] Foreign Application Priority Data

July 19, 1975 Germany ..... 2532432

[51] Int. Cl.[2] ..... B65B 13/00

[52] U.S. Cl. ..... 53/198 B; 53/292; 53/294

[58] Field of Search ..... 53/118, 198 B, 291, 53/292, 293, 294, 295, 190, 116

[56] References Cited

U.S. PATENT DOCUMENTS

| | | | |
|---|---|---|---|
| 1,875,110 | 8/1932 | Myers | 53/198 B X |
| 1,962,481 | 6/1934 | Clark | 53/292 X |
| 2,089,769 | 8/1937 | Strout | 53/198 B X |
| 2,752,030 | 6/1956 | Erickson | 53/291 X |
| 2,858,660 | 11/1958 | Browne | 53/291 |
| 2,866,307 | 12/1958 | Rigg | 53/198 B X |
| 3,267,566 | 8/1966 | Ouellette | 53/292 X |
| 3,861,118 | 1/1975 | Muto | 53/292 X |

FOREIGN PATENT DOCUMENTS

| | | |
|---|---|---|
| 1,396,468 | 6/1975 | United Kingdom. |

*Primary Examiner*—Othell M. Simpson
*Assistant Examiner*—John Sipos
*Attorney, Agent, or Firm*—Fleit & Jacobson

[57] ABSTRACT

A device on a skein winding machine for the application of bands to banding flaps arranged on a movable carrier, which includes a band feeder for withdrawing a band from a magazine band applying the bnd to the banding flaps in an initial setting of the carrier, for subsequent transfer of the applied bands by the motion of the carrier to a completely wound skein, subsequently depositing the banded skein on a deposit location and finally returning to the initial setting.

8 Claims, 12 Drawing Figures

2
13
14
12
11
4
15
17
16
19
18
20
23
22
29
77
9
8
7
27
6
5
3
4
34
35
31
32
33
1

37
6
5
21
7
11
8
4
9
3
20
22
29
32
31
33

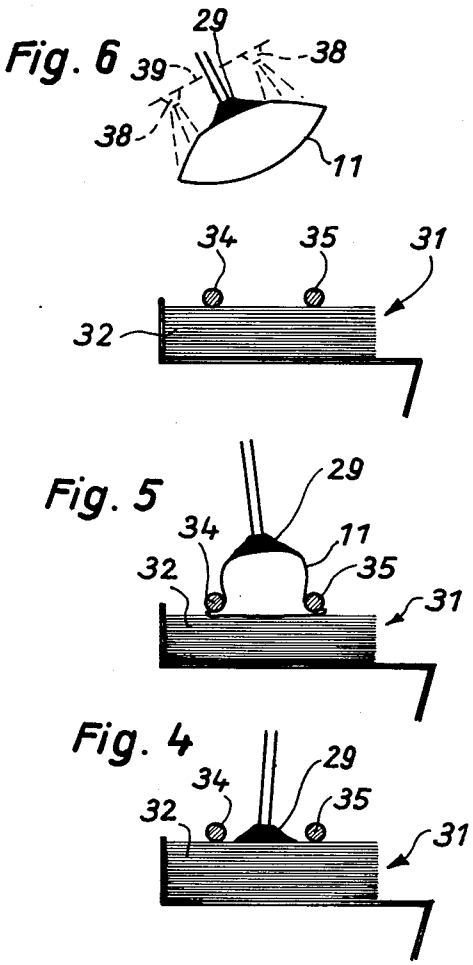
Fig. 6
Fig. 5
Fig. 4
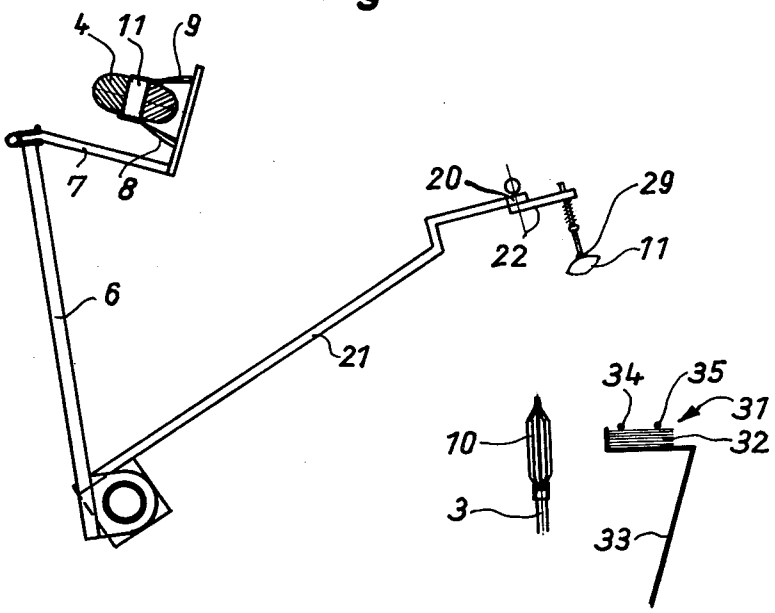
Fig. 3

BAND APPLYING DEVICE FOR A SKEIN WINDING MACHINE

BACKGROUND OF THE INVENTION

In a well-known skein winding machine with which this invention is concerned and as described in Swiss Patent Specification No. 557,779, the bands must each be pushed by hand each time onto the banding flaps. This is an awkward and time-consuming process and requires the constant presence of an operator at the machine who continuously applies bands at the proper moment in time at several winding locations provided beside one another on the machine.

SUMMARY OF THE INVENTION

It is the object of this invention to automate the application of bands to the banding flaps of a skein winding machine.

According to the invention, the problem is solved by the provision of a pivotable band feeder provided with a suction mouthpiece which withdraws the bands from a magazine under the effect of a negative pressure prevailing in the suction mouthpiece and places them over the banding flaps disposed in the initial setting of a movable carrier by a rotary motion initiated by a drive.

BRIEF DESCRIPTION OF THE DRAWINGS

The following description of the preferred embodiments of the invention serves as a further explanation in connection with the accompanying drawings in which:

FIG. 3 is a schematic detailed view of the machine of FIG. 1 in still another functional setting;

FIG. 4 is a side elevation view of a stack of bands arranged in a magazine with a suction mouthpiece placed thereon;

FIG. 5 is a view similar to FIG. 4 showing the first step in the process of withdrawal of a band from the magazine;

FIG. 6 is a view similar to FIG. 5 showing a further step in the band withdrawal process;

PREFERRED EMBODIMENTS OF THE INVENTION

Figure 1:
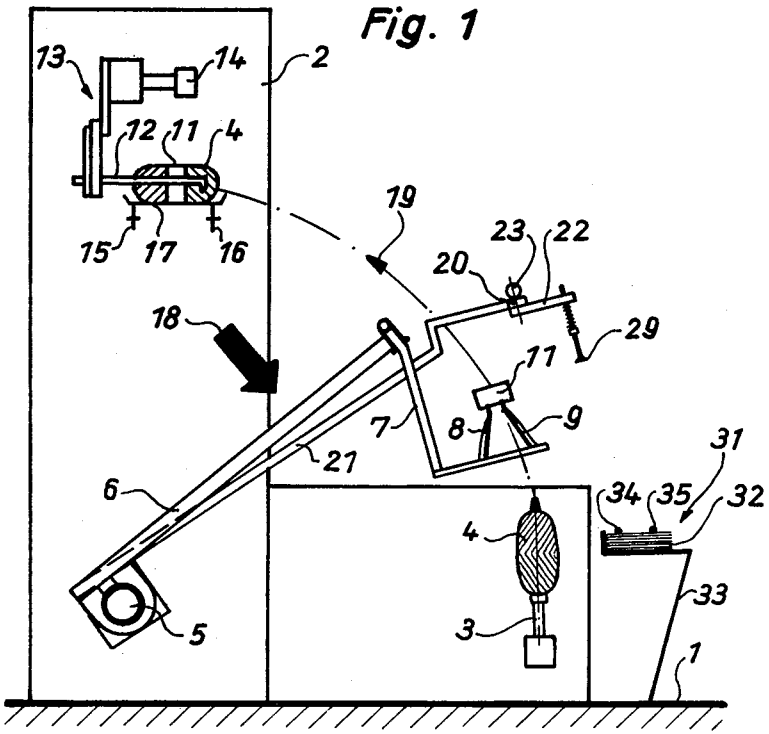
FIG. 1 is a schematic side elevation view of a skein winding machine with the basic construction of the device according to the invention.

There is shown in FIG. 1 portions of a not otherwise illustrated, well-known skein winding machine which includes a machine frame 2 resting on a firm support on such as, for example, a floor and a rotatably driven winding mandrel 3 on which a skein 4 of yarn, thread or the like is formed in the well-known manner, for example, by means of a winding blade. The skein mandrel 3 usually comprises a collapsible rod structure 10, as shown in FIG. 3, which is disposed in the interior of the skein 4 and which makes possible a reduction of the mandrel diameter at a suitable point in time so that the pulling-off of the skein 4 from the mandrel 3 proceeds more easily. Fastened to a shaft 5, which is mounted on the machine frame 2 and which is pivotable to and fro by means of a well known drive mechanism (not shown) is a pivot arm 6 pivotable by the shaft 5 in a plane perpendicular to the firm support. Seated on the free end of the pivot arm 6 is an angled carrier 7 on which two banding flaps 8 and 9 are arranged for the reception of a band 11 to be applied to the skein 4. The structure of the flaps 8 and 9 and their arrangement on the angled carrier is shown and described in this aforementioned Swiss patent specification.

Abutment means with at least one rod 12, having an end bent over into the shape of a hook are also provided on the machine frame 2 and two such rods 12 are usually provided. The rods 12 are moved towards one another at the right point in time in the known manner by a scissors linkage 13 and a drive 14. Provided underneath the rods 12 is a conveyor which consists of two chains 15 and 16, the conveying direction of which is directed perpendicularly to the plane of FIG. 1. Fastened to the chains 15 and 16 are pans 17 which serve to receive banded skeins 4.

The device described so far acts in the following manner: During the formation of the skein 4 on the rotating winding mandrel 3, the pivot arm 6 with the banding flaps 8 and 9 is disposed approximately in the initial setting shown in FIG. 1. A band 11 is manually mounted on the free ends on the banding flaps 8 and 9 by an operator in the case of present day devices. When the skein 4 has been completely wound and the winding mandrel 3 has come to a standstill, the arm 6 is pivoted downwardly in the direction of the arrow 18 so that flaps 8 and 9 are moved forward against the skein 4. The flaps 8 and 9 then push over the skein 4 and during the process, place the band 11 over the skein. On the return motion of the flaps 8 and 9 in the direction of arrow 19, the skein 4 is drawn off from the collapsed mandrel 3 of FIG. 3 and carried upwardly by the flaps 8 and 9. For this purpose barbs are, for example, provided on the inside of those surfaces of the flaps 8 and 9 which engage the skein 4.

Upon further pivotal movement of the arm 6 in direction of the arrow 19, the skein 4, held between the flaps 8 and 9 together with the band 11, moves into the region between the two rods 12, which are now by a suitable control urged laterally against the skein 4 and the band 11. Now, the direction of motion of the arm 6 is again reversed so that it returns in the direction of the arrow 18 into the initial position shown in FIG. 1. In that case, the ends of the banding flaps 8 and 9, still lying between the band 11 and the skein 4, slide away from the skein because of the retention of the skein 4 by the rods 12 so that the skein 4 lies in the now banded state on the pan 17 which transports the skein away. Now, a new band 11 is mounted onto the banding flaps 8 and 9 which have now returned into the initial setting and the above described process is repeated.

The construction described so far and its mode of operation are conventional as described, for example, in the aforementioned Swiss patent specification. According to the invention, a device is now proposed with the aid of which the hitherto manually accomplished application of the bands 11 to the banding flaps 8 and 9 in their initial setting proceeds automatically. To this end, a pivot arm 21, which is pivotable up and down just as the arm 6 in a plane substantially perpendicular to the firm support, is provided which pivots on the shaft 5 but preferably movable independently from the shaft 5 by a corresponding drive mechanism. The drive mechanism can be of conventional construction and need therefore not be described in detail here. The drive mechanism is coordinated by a well-known time control with the movements of the remaining machine parts such as, especially the arm 6 and the rods 12.

At the free end of the pivot arm 21, a rotary arm 22 is articulatedly mounted with the interposition of a carrier 20, the arm 22 being rotatable in a plane lying substantially perpendicular to the pivot plane of the pivot arm 21. In the illustrated embodiment of FIG. 7, rotation of the arm 22 is accomplished, for example, by pneumatically actuated, pressure means cylinder 23. The cylinder 23 is fastened to the carrier 20 and includes a piston rod 24 which is connected with the one end of a chain or cable 25. The chain 25 is guided around a chain wheel 26 rigidly connected to the rotary arm 22 and extends from there to a spring 27, which holds the chain 25 under tension. During the retraction of the piston rod 24 into the cylinder 23 (to the left as viewed in FIG. 7) the rotary arm 22 pivots over the angular range indicated by the arrow 28, while the free end of the rotary arm 22 is brought to a position approximately above the banding flaps 8 and 9.

Figure 2:
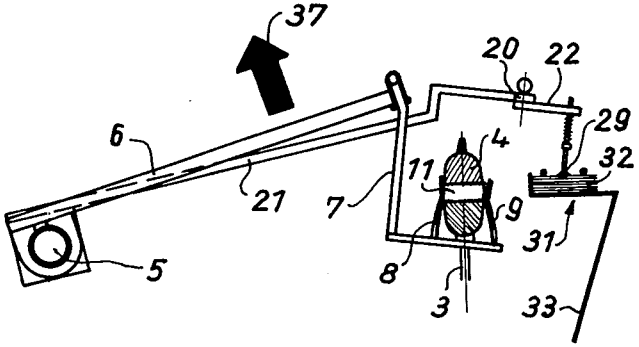
FIG. 2 is a schematic detailed view of another functional setting of the machine of FIG. 1.

A suction mouthpiece 29 is provided, which is connected by suitable means to a source of vacuum (not shown) and which projects downwardly from the rotary arm 22. The mouthpiece 29 is elastically retained, preferably by a spring, at the free end of the rotary arm 22 as shown in FIG. 2.

Figure 8:
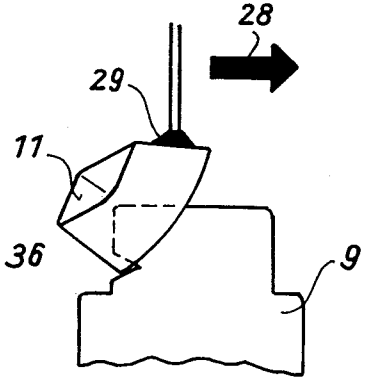
FIG. 8 is a fragmentary view illustrating the placing of a band over the banding flaps.
Figure 9:
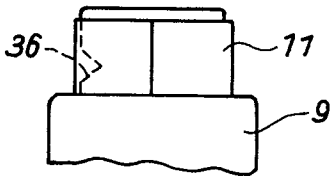
FIG. 9 is a view similar to FIG. 8 showing the band placed over the banding flaps.

Finally, a magazine 31, indicated schematically in the drawing, for a stack of bands 32 is provided in the range of movement of the suction mouthpiece 29. The magazine 31 can be supported by a stand 33 on the floor 1 or on the machine frame 2. Two rods 34 and 35 extend transversely to the bands 11 above the stack 32 arranged in the magazine 31. Finally, as shown in FIGS. 8 and 9, the banding flaps 8 and 9 or at least one of them is preferably provided with a notch 36 for a purpose to be explained hereinafter.

The device according to the invention acts as following: While the banding flaps 8 and 9, fastened to the arm 6 and carrying a band 11, are pushed over the skein 4 disposed on the winding mandrel 3 as shown in FIG. 2 and the skein 4 is subsequently conveyed as shown in FIG. 3 in the direction of the deposit location as represented by pan 17 in FIG. 1, the suction mouthpiece 29, provided with negative pressure and fastened to the arms 21 and 22, is placed upon the uppermost band 11 of the stack 32 in the magazine 31 as shown in FIG. 2 and picks up the uppermost band as shown in FIG. 3 during the return motion in the direction of the arrow 37. The pulling-off process of the uppermost band 11 from the stack 32 is illustrated in detail in FIGS. 4, 5, and 6. In FIG. 4, the suction mouthpiece 29 of the band feeder engages the uppermost band 11. All bands 11 are formed in the shape of a ring as closed bands and are folded together flat. The suction mouthpiece 29 engages the upper layer of the folded band and draws this upper layer through the underside of rods 34 and 35 in the manner shown in FIG. 5 whereby the band 11 is opened under constraint. FIG. 6 shows the opened band 11 retained by the suction mouthpiece 29. FIG. 6 therefore corresponds to FIG. 3.

If desired, the relative spacing between the rods 34 and 35 and the bottom of the magazine 31 can be made variable in such a manner that on continuous withdrawal of bands 11 and the attendant reduction of the stack 32 either the bottom of the magazine or the rods 34 and 35 are so moved towards one another that the rods 34 and 35 always lie in the proximity of the uppermost band 11 and ensure the opening motion of the bands as shown in FIG. 5.

As illustrated in FIG. 6 there is shown a modification of the device according to the invention including air nozzles 38, connected with a source of compressed air (not shown) which can be arranged by means of a carrier 39 on the suction mouthpiece 29 whereby the nozzles 38 direct a current of compressed air against the band 11 so that it curves and thus opens in the illustrated manner.

Figure 7:
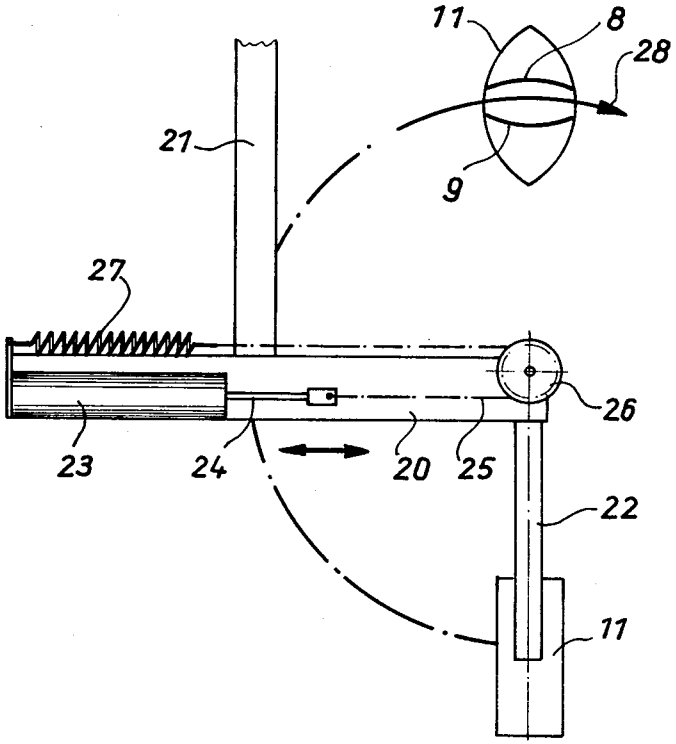
FIG. 7 is a schematic partial plan view of the band applying device of the invention.

When the band feeder carrying a band 11 and provided with the suction mouthpiece 29 reaches the position illustrated in FIGS. 1 and 3 and the arm 6 with the banding flaps 8 and 9 has returned into its initial setting shown in FIG. 1 with the flaps 8 and 9 no longer carrying a band 11, the pressure means cylinder 23 is actuated and the rotary arm 22 carrying the band 11 is pivoted in direction of the arrow 28 up to and over the banding flaps 8 and 9 as shown in FIGS. 7–9. During this movement, the lower edge of the opened band 11 engages the notch 36 in the manner shown in FIG. 8 and is retained therein. As the suction mouthpiece 29 moves further in direction of arrow 28, the band 11 is finally completely placed over the free end of the banding flaps 8 and 9, while the suction mouthpiece 29 releases the band. Thereafter, the suction mouthpiece 29 returns in the direction of the arrow 40 into the initial setting shown in FIG. 7.

The notch 36 shown in FIGS. 8 and 9 is not absolutely necessary for an orderly placing of the band 11 over the flaps 8 and 9. It merely facilitates the orderly initiation of the band placing-over process. To facilitate the release of the suction mouthpiece 29 between the positions according to FIGS. 8 and 9, the negative pressure in the mouthpiece 29 can be momentarily switched off when the side of the band, which lies opposite the notch 36 and which is held by the mouthpiece 29, has moved beyond the unnotched edge of the flaps 8 and 9, so that the band 11 drops off from the mouthpiece 29 and moves into the position shown in FIG. 9. It has been found however that the suction mouthpiece 29 comes free of the band due to the retention of the one side of the band 11 at the one edge of the flaps 8 and 9. To facilitate this, the negative pressure in the mouthpiece 29 providing the suction force can be appropriately adjusted. Finally, it can also be advantageous to impart a slight downward motion in the suction mouthpiece 29 during the transition from the setting according to FIG. 8 into that according to FIG. 9, for example, by downward pivoting of the pivot arm 21, whereby the placing of the band over the banding flaps 8 and 9 is likewise facilitated. All these additional movements and adjustments can be accomplished immediately by the average expert with conventional means and electrical controls.

Figure 12:
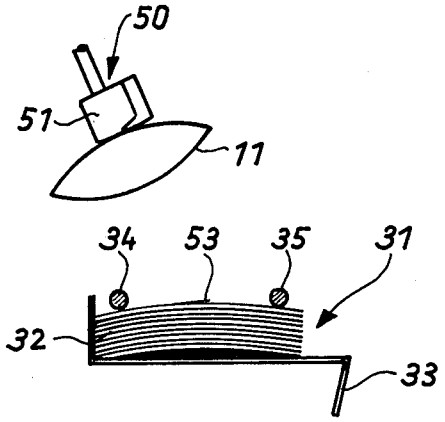
FIG. 12 is a view similar to FIG. 6 of the modification of FIG. 10.
Figure 11:
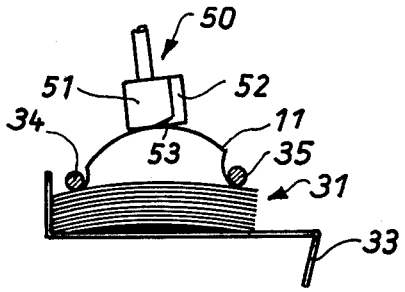
FIG. 11 is a view similar to FIG. 5 of the modification of FIG. 10.
Figure 10:
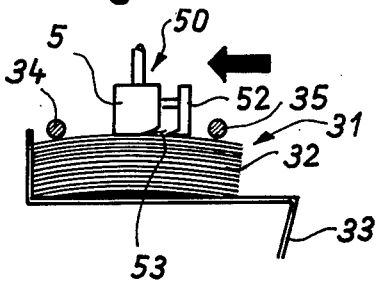
FIG. 10 is a view similar to FIG. 4 showing a modification of the invention.

In the case of the modification of the invention shown in FIGS. 10 to 12, the suction mouthpiece 29 is replaced by a clamping member 50, which consists of two cheeks 51 and 52 movable relative to one another mechanically, pneumatically or hydraulically. This clamping member is suitable for bands of the type which are cemented together in the shape of a ring out of a strip of paper or the like in such a manner that the one end 53 of the strip slightly protrudes free upwardly and is not glued to the rest of the strip.

The clamping member 50 is, as shown in FIG. 10, placed upon the stack of bands 32. The initially opened clamping cheek 52 is so advanced against the cheek 51 that the hook-shaped end of the cheek 52 moves below the free end 53 and clamps this end 53 securely against the cheek 51. Thereafter, the band 11 is raised from the stack with the aid of the rods 34 and 35 as shown in FIGS. 11 and 12 in the manner previously described with reference to FIGS. 5 and 6 and placed over the banding flaps 8 and 9 in the manner shown in FIGS. 8 and 9 while the cheeks 51 and 52 can again be opened after completion of the placing-over or the band may be drawn out from between the closed cheeks. The course of movement of the clamping member 50 can, in that case, correspond exactly to the course of movement of the suction mouthpiece 29. The clamping member 50 acts just as the suction mouthpiece as a retaining member for the band 11.

What is claimed is:

1. A band applying device for use with a skein winding machine, the device applying a band to a completely wound skein mounted on a winding mandrel of the winding machine, the device, after applying the band to the skein, removing the skein from the mandrel and transferring the skein to a deposit location, said device comprising:

a magazine for accommodating a stack of collapsed bands;

a first pivot arm pivotally connected to the skein winding machine for movement in a first plane, said first pivot arm supporting two banding flaps, the inner surfaces of said flaps being provided with barbs for carrying the skein, said flaps being adapted to receive a band when said first pivot arm is in an initial setting;

a drive mechanism for pivoting said first pivot arm in a first direction from said initial setting towards the mandrel thereby pushing a band carried by said flaps over the skein, said drive mechanism being adapted for pivoting said first pivot arm in a direction opposite said first direction for removing the skein from the mandrel and for transferring the skein to the deposit location, said drive mechanism being further adapted for pivoting said first pivot arm in said first direction for removing said flaps from said skein and for returning said first pivot arm to said initial setting;

retention means operatively associated with the deposit location for retaining the banded skein in the deposit location while said flaps are being removed;

a second pivot arm having one end pivotably connected to the skein winding machine for pivotal movement in a second plane substantially parallel to said first plane;

driving means for pivoting said second pivot arm between a first position wherein a band is withdrawn from said magazine and a second position wherein the band is positioned over said banding flaps;

a rotary arm articulatedly fastened to the other end of said second pivot arm for rotation in a plane substantially perpendicular to said first and second planes;

band holding means attached to said rotary arm for securing, holding, positioning, and placing the band over said holding flaps;

driving means for rotating said rotary arm between a first position associated with said magazine wherein said band holding means withdraws a band from said magazine, the band being opened as it is withdrawn from said magazine, and a second position associated with said banding flaps wherein said band holding means positions and places the band over said banding flaps, said banding flaps in said initial setting of said first pivot arm being disposed in the path of rotation of said band holding means from said first position to said second position.

2. A device according to claim 1, wherein said band holding means comprises a mouthpiece using negative pressure and wherein said driving means for the rotary arm includes a pressure means cylinder for rotating said rotary arm throughout said path of rotary movement.

3. A device according to claim 1 wherein the banding flaps are provided with a notch for hooking engagement with the band held by said band holding means during the movement of said rotary arm into said second position.

4. A device according to claim 2 wherein the negative pressure in the suction mouthpiece is arranged to be switched off temporarily shortly before the completion of the process of placing the band over the banding flaps in order to facilitate the separation of the band from said mouthpiece.

5. A device according to claim 2 wherein the suction mouthpiece is arranged to be lowered slightly shortly before the completion of the process of placing the band over the banding flaps.

6. A device according to claim 1 including a pair of rods arranged in transversely spaced relationship above a stack of bands accommodated in said magazine, whereby the uppermost band in the stack in said magazine is pulled through and below said rods by said band holding means during the movement of said second pivot arm from said first position to said second position.

7. A device according to claim 1 including a plurality of air nozzles disposed in the proximity of said band holding means to promote the opening of a band withdrawn from said magazine.

8. A device according to claim 1 wherein said band holding means includes a clamping member for withdrawing a band to be applied from said magazine.

* * * * *